US005184660A

United States Patent [19]

Jelic

[11] Patent Number: 5,184,660

[45] Date of Patent: Feb. 9, 1993

[54] WINDOW BLIND ACTIVATOR

[75] Inventor: Ralph Jelic, Valencia, Pa.

[73] Assignee: Verosol USA Inc., Pittsburgh, Pa.

[21] Appl. No.: 786,282

[22] Filed: Nov. 1, 1991

[51] Int. Cl.[5] ..... E06B 9/30

[52] U.S. Cl. ..... 160/171; 160/84.1

[58] Field of Search ..... 160/170, 171, 84.1, 160/243, 244, 245, 321

[56] References Cited

U.S. PATENT DOCUMENTS

| | | | |
|---|---|---|---|
| 2,738,005 | 3/1956 | Nisenson | 160/170 |
| 3,141,497 | 7/1964 | Griesser | 160/170 |
| 3,439,726 | 4/1969 | Lageson | 160/170 |
| 4,793,396 | 12/1988 | Anderson et al. | 160/84.1 |
| 4,919,186 | 4/1990 | Uecker et al. | 160/84.1 X |
| 5,070,927 | 12/1991 | Chen | 160/171 X |

*Primary Examiner*—David M. Purol

*Attorney, Agent, or Firm*—Buchanan Ingersoll; Lynn J. Alstadt

[57] ABSTRACT

A device for raising and lowering window blind fabrics. The device has a hollow take-up tube disposed around and threadably engaged to a stationary guide. A cord is connected at its one end to the take-up tube and at its other end to the blind fabric. The take-up tube is rotated to wind or unwind the cord. A drive core rotatably disposed within a bi-directional friction brake, the drive core connected to the take-up tube, the bi-directional friction brake being fixed to the headrail. When the cord is wound around the take-up tube, the blind fabric is raised. When the cord is unwound, the blind fabric is lowered.

16 Claims, 4 Drawing Sheets

WINDOW BLIND ACTIVATOR

BACKGROUND OF THE INVENTION

1. Field of the Invention

This invention relates generally to the field of window blinds and more particularly to means of raising and lowering collapsible blind fabrics.

2. Description of the Prior Art

Many window blind assemblies employ collapsible blind fabric which extends from a headrail mounted adjacent a window or door. These collapsible fabric window blind assemblies are operated by raising or lowering the blind fabric. The term "blind fabric" refers to material used as a covering in venetian blinds, roman blinds, honeycomb blinds and pleated blinds.

It is known to raise and lower the blind fabric by intermittently passing a cord through the blind fabric and connecting the cord to the blind fabric at some point. This cord typically enters the headrail, passes over a roller located in the headrail, and then exits the headrail, hanging down alongside the blind fabric. When the cord is pulled downward, the blind fabric is drawn upward. As the cord is allowed to move up, the weight of the blind fabric causes the blind fabric to move down. This general concept is usually known to employ more than one cord.

Devices used to activate the cord upward or downward are known that incorporate a hollow take up tube disposed around and threadably engaged to a stationary threaded guide. In such devices, a cord is connected at its one end to the take-up tube and at its other end to the blind fabric. The take-up tube is then activated to manually rotate to wind or unwind the cord. Such a device is generally known as a tube cord lift system.

It is also known to staple the uppermost portion of the blind fabric to a long, rectangular strip. This strip is then slid into a groove along the bottom of the headrail and the blind fabric is thus attached to the headrail.

When raising or lowering the blind, it is desirable for the blind fabric to remain in the position it has been placed. For this reason, various clutch means have been employed in the art. A common clutch means is a bi-directional clutch. Some examples of this type of clutch are shown in U.S. Pat. No. 4,372,432 and U.S. Pat. No. 4,433,765. A typical bi-directional clutch employs two generally cylindrical elements, one being a drive element and the other being a driven element. The elements are designed with a transmission and locking means, typically one or more springs, cooperating with them so that when a torque is applied to the drive element in either direction, the drive element is rotated which turns the driven element as well. However, a torque applied directly to the driven element will result in the driven element being locked in position. This locking means is generally effective, however, the springs utilized in the above system generally make a complete rotation for each rotation of the cylindrical element. Thus, as the spring rotates, a repetitive noise, called chatter, is produced. Furthermore, as the cylindrical elements are rotated, the spring is continually engaging and disengaging thus producing a vibration in the cords and the shade. It also creates a resistance that increases the actual load to the operator.

A bi-directional limit torque slip element as disclosed in U.S. Pat. No. 3,450,365 to Kaplan employs a spring having a varying diameter. Such a slip element mechanism would be particularly useful in a window blind system due to the desire to have different pre-torques acting in opposite directions and would reduce many of the shortcomings in the above-mentioned pre-torque means.

SUMMARY OF THE INVENTION

The present invention provides a device for raising and lowering pleated window blinds. The present device is a tube cord lift system that employs a bi-directional, friction brake in cooperation with a drive core which enables a greater pre-torque in one rotational direction than the opposite rotational direction. The present invention thus transmits torque directly through a drive core and not through a clutch. Furthermore, the present invention utilizes a pre-torque means that is quieter than the clutch devices previously utilized in the art. This is due to the varying-diameter spring utilized in the friction brake not having to rotate with every rotation of the drive core and to the more continual disengagement of the varying-diameter spring during rotation. The preferred means of rotating the take-up tube is an endless pull cord cooperating with the drive core. Another means of rotating the take-up tube is the drive core cooperating with an elongated pull cord or a wand operated worm gear. Stops are provided to prevent the take-up tube from travelling more than a predetermined amount in a longitudinal direction. Preferably endplugs or collars attached to the tube are used as stops. Other details, objects and advantages of the invention will become apparent as the following description of certain present preferred embodiments thereof proceeds.

DESCRIPTION OF THE PREFERRED EMBODIMENTS

Figure 1:
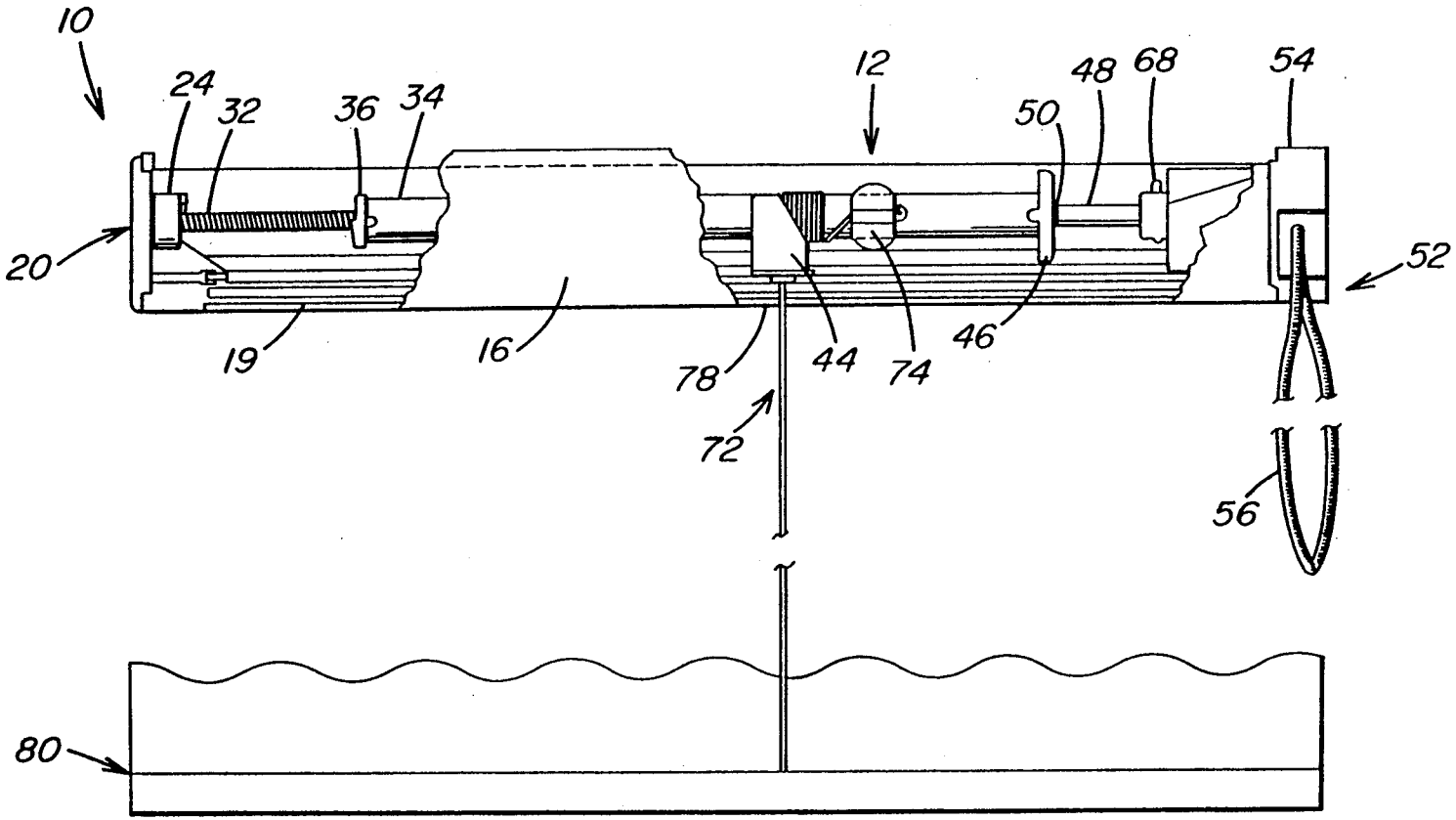
FIG. 1 a front view partially cut away of the present preferred embodiment.
Figure 2:
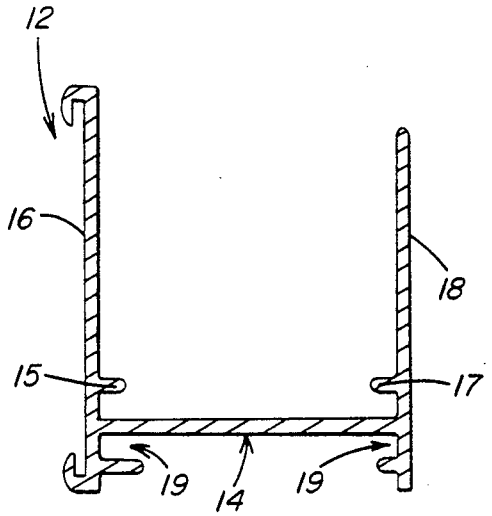
FIG. 2 is a side view of the preferred headrail.

Referring first to FIG. 1, system 10 has an elongated headrail 12. The preferred design of headrail 12, a side view of which is shown in FIG. 2, is as follows. A bottom face 14 that is generally parallel to the ground extends longitudinally adjacent to the upper portion of a window or door. A front face 16 extends upward perpendicularly from the front longitudinal edge of bottom face 14. Front face 16 has a portion 15 that extends parallel to bottom face 14. A rear face 18 extends upward perpendicularly from the rear longitudinal edge of bottom face 14. Rear face 18 has a portion 17 that extends parallel to bottom face 14. Front face 16 is parallel to rear face 18. Thus, the preferred headrail 12 is generally U-shaped. Headrail 12 is also preferably open-ended.

Where front face 16 meets bottom face 14, front face 16 extends dc nward approximately an eighth of an inch past the front longitudinal edge of bottom face 14. Front face 16 then curves approximately an eighth of an inch back towards rear face 18 creating one side of a longitudinal groove 19. Similarly, where rear face 18 meets bottom face 14, the other side of longitudinal groove 19 is formed. Grooves 19 are located directly opposite one another. Groove 19 is thus bordered on one side by bottom face 14 and front face 16 and a the other side by bottom face 14 and rear face 18.

Figure 3:
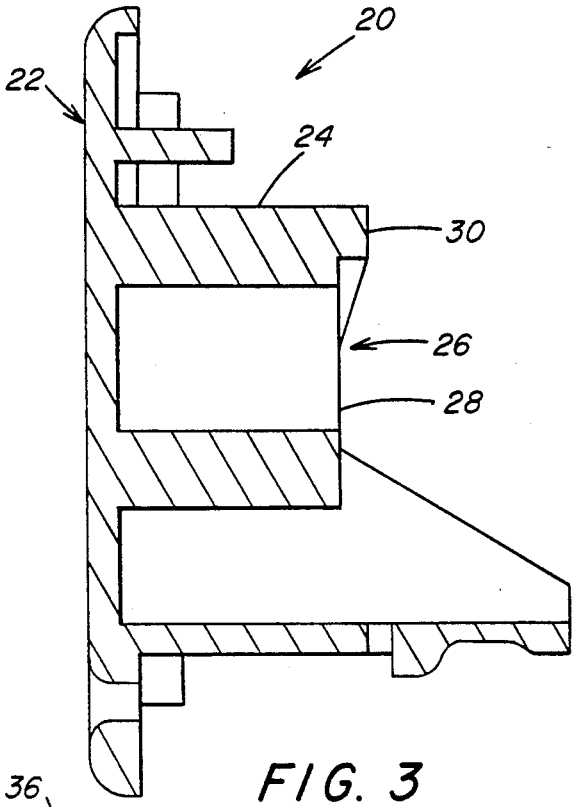
FIG. 3 is a side view of the endplug.

Disposed at one end of headrail 12 is end plug 20. End plug 20, shown in FIG. 3, has a backing portion 22 which is generally square and abuts the end of headrail 12 thereby enclosing that end. End plug 20 further has an extending portion 24 which extends perpendicularly from backing portion 22 and extends longitudinally within U-shaped headrail 12. Extending portion 24 of end plug 20 has a cylindrical hole 26 bored longitudinally into it at its center. Thus, extending portion 24 has an annular surface 28 facing away from backing portion 22. A portion of endplug annular surface 28 that extends radially from cylindrical hole 26 is raised to form a ledge 30. A threaded guide 32 is fixed within cylindrical hole 26. Threaded guide 32 extends away from backing portion 22 of endplug 20 extending longitudinally within U-shaped headrail 12. Threaded guide 32 is a cylindrical section of threaded material.

Figure 4:
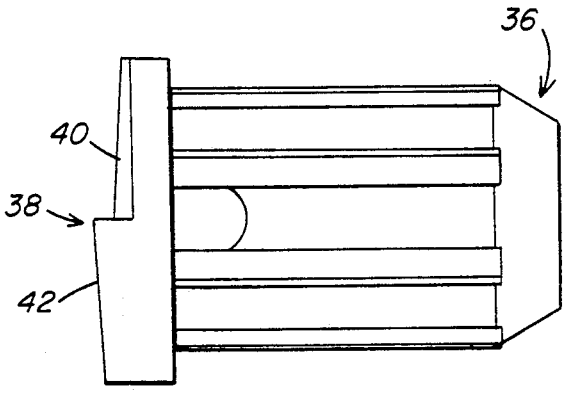
FIG. 4 is a side view of the threaded insert.

A hollow, cylindrical take-up tube 34 is placed around threaded guide 32. Take-up tube 34 has a threaded insert 36 fixed at its one end. Shown in FIG. 4, threaded insert 36 has a threaded hole 38 through its center, through which threaded guide 32 is disposed. As threaded insert 36 rotates relative to threaded guide 32, threaded insert 36 carries take-up tube 34 longitudinally along threaded guide 32. Threaded insert 36 has an annular surface 40 facing toward endplug 20. The outside diameter of annular surface 40 is greater than the outside diameter of take-up tube 34. Threaded insert annular surface 40 has a raised ledge 42 extending radially from threaded hole 38.

Figure 5:
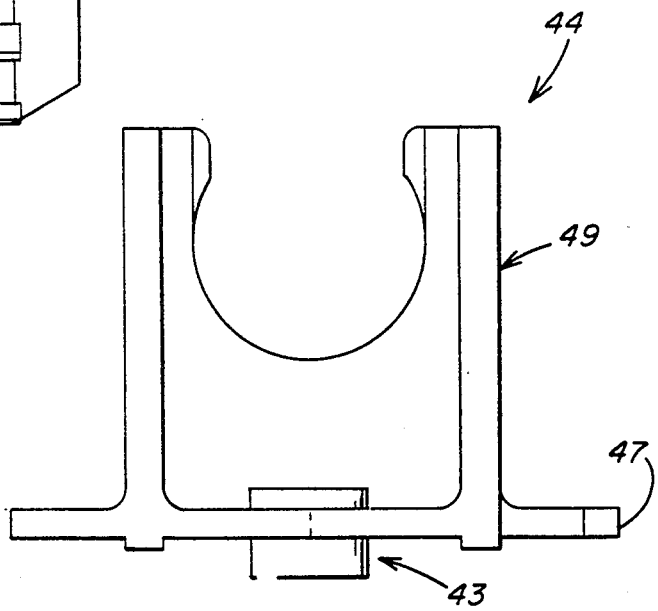
FIG. 5 is a front view of a cradle.

Take-up tube 34 is rotatably secured within headrail 12 preferably by at least two cradles 44. Cradles 44, shown in FIG. 5, have a base portion 47 and an extending portion 49. Cradles 44 are secured to headrail 12 by any convenient means, however, the preferred means is by fitting base portion 47 within the area bordered by front face 16 and front face portion 15 on one side and rear face 18 and rear face portion 17 on the other side. Also, cradles 44 have a port 43 extending from base portion 47. The cradle ports 43 are then fitted through a hole in bottom face 14 of headrail 12.

As take-up tube 34 is rotated, threaded insert 36 travels along the thread of threaded guide 32. As threaded insert 36 travels along the length of threaded guide 32, take-up tube 34 is carried longitudinally along threaded guide 32. When threaded insert 36 travels longitudinally to where it reaches endplug 20, threaded insert ledge 42 will engage endplug ledge 30. Once threaded insert ledge 42 contacts endplug ledge 30, take-up tube 34 will not be able to rotate further in that direction or travel longitudinally further in that direction.

Take-up tube 34 has a tube plug 46 fixed at its end opposite to threaded insert 36. A drive shaft 48 extends through a hole 50 on tube plug 46 and extends into take-up tube 34. Drive shaft 48 has preferably a square cross section as does hole 50 through tube plug 46. Hole 50 is sized so as to engage drive shaft 48, thus as drive shaft 48 is rotated, take-up tube 34 is rotated. And as take-up tube 34 is rotated, tube 34 travels longitudinally about threaded guide 32. The engagement of drive shaft 48 with tube plug 46 through plug hole 50 allows a rotational force to be transmitted from drive shaft 48 to tube plug 46 while allowing take-up tube 34 to move longitudinally relative to drive shaft 48.

Figure 6:
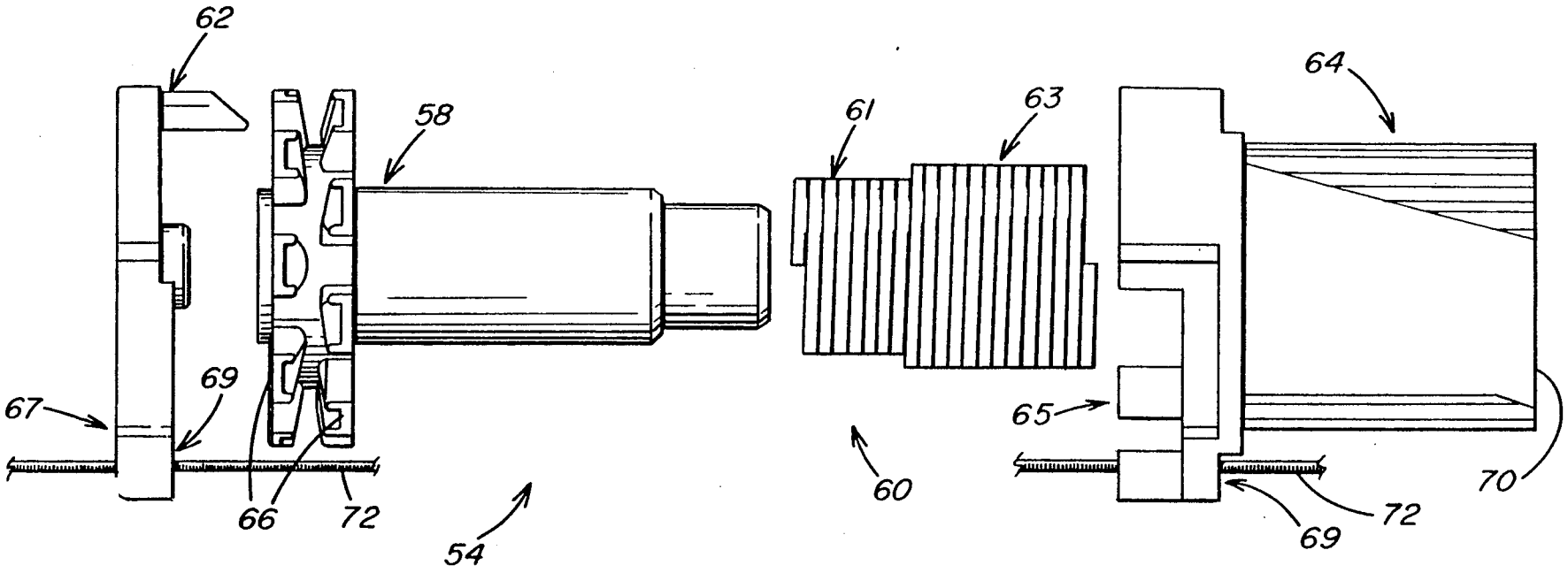
FIG. 6 is an exploded view of the drive core and friction brake of the preferred embodiment.

Drive shaft 48 is fixed to drive means 52. The preferred drive means is a bi-directional friction brake 54 cooperating with a drive core 58 engaged with an endless pull cord 56. Drive means 52 shown in FIG. 6, has a generally cylindrical brake core 58, a varying-diameter spring 60, a brake cover 62 and a brake housing 64 that has a generally cylindrical inner surface. Drive core 58 is rotatably enclosed within brake housing 64 and brake cover 62. Varying-diameter spring 60 is located between drive core 58 and brake housing 64. Varying-diameter spring 60 is designed to provide a pre-torque on drive core 58 in both the clockwise and counterclockwise directions. Drive core 58 has protrusions 66 within which endless pull cord 56 is disposed. Protrusions 66 are spaced a selected amount apart so that endless pull cord 56 fits snugly within some of protrusions 66. The rest of endless pull cord 56 extends down from the clutch 54. Thus, frictional forces acting between pull cord 56 and protrusions 66 cause a force applied to pull cord 56 in a chosen direction to be transmitted to drive core 58. This force transmitted to drive core 58 creates a torque acting upon drive core 58 causing drive core 58 to rotate in the direction of the force on pull cord 56. Drive shaft 48 is fixed to drive core 58 by cotter pin 68, therefore, as drive core 58 rotates, drive shaft 48 rotates as well. Brake housing 64 has a hole 70 placed on it. Drive shaft 48 extends from drive core 58 through brake housing hole 70 is supported by and engages with tube plug 46.

Brake cover 62 and brake housing 64 are joined together by any convenient means such as gluing or rivots, but the preferred means is by screws. Brake housing 64 has several generally cylindrical screw housings 65 extending toward brake cover 62. Brake cover 62 has several screw holes 67 located so that each screw housing 65 has a corresponding screw hole 67 adjacent to it when brake cover 62 is in position against brake housing 64. Screws (not shown) are then placed through screw holes 67 and are tightened into screw housing 65. Any number of screws with corresponding screw holes 67 and screw housing 65 can be used, however, it is preferred that two be located beneath and at each side of protrusions 66. When the screw holes 67 and screw housings 65 are located thus, the screws and screw housings 65 act as additional supports and guides for endless pull cord 56. Brake cover 62 is then secured at the end of headrail 12 opposite to the end having end plug 20.

Figure 7:
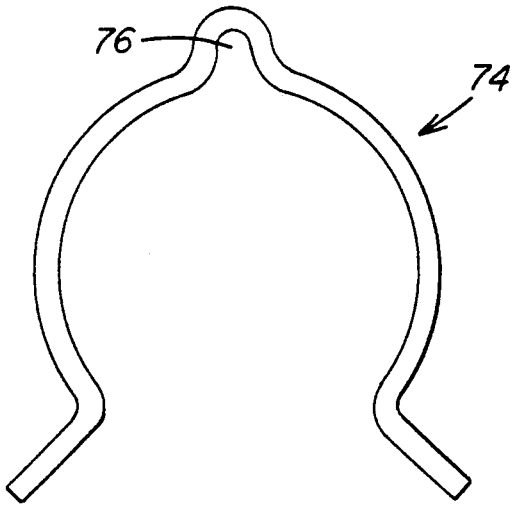
FIG. 7 is a front view of the tube clip.
Figure 8:
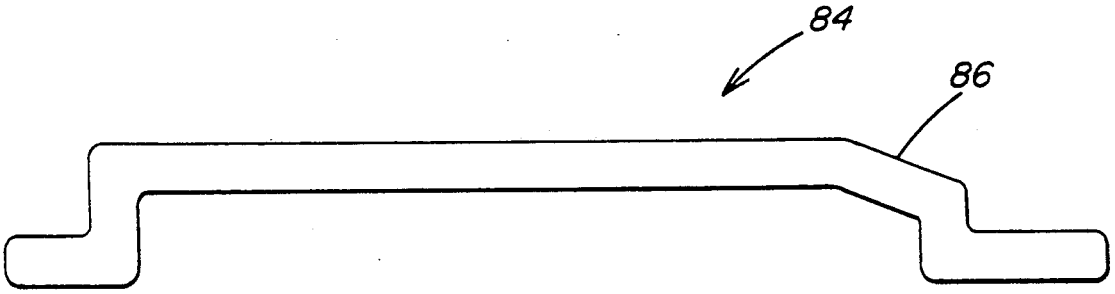
FIG. 8 is a side view of the offset profile.

One end of an elongated blind cord 72 is connected to take-up tube 34. A tube clip 74, shown best in FIG. 7, has a generally semi-circular cross section and has a channel 76. Tube clip 72 is sized to fit snugly around take-up tube 34. Blind cord 72 is placed through channel 76 and an end of that portion of blind cord 72 is knotted. The knot on the end of blind cord 72 is larger than the space created between channel 76 and take-up tube 34 so that the knot on blind cord 72 can not be pulled through channel 76. An opening 78 is made on headrail 12 through which blind cord 72 passes. The end of blind cord 72 is secured to the bottom of a collapsible section of blind fabric 80. Blind cord 72 need not travel directly from frame opening 78 downward to the bottom of blind fabric 80. Rather, blind cord 72 can travel from frame opening 78, longitudinally along groove 19 and then downward to the bottom of blind fabric 80. An offset profile 84 is placed within grooves 19. Offset profile 84, shown in FIG. 8, is designed so that when offset profile 84 is placed within grooves 19 and an edge of blind fabric 80 is then inserted into groove 19, the offset profile 84 and blind fabric 80 are held securely within groove 19. Offset profile 84 is designed so that one longitudinal edge of offset profile 84 is angled. This angled edge 86 facilitates the entry of fabric 80 into groove 19.

In operation, the side of endless pull cord 56 is pulled on the left of bi-directional friction brake 54 which applies a counter-clockwise torque on clutch core 58. When this manually applied torque overcomes the initial torque of varying-diameter spring 60, drive core 58 rotates, which rotates drive shaft 48 in the counter-clockwise direction. Drive shaft 48 then engages with tube plug 46 to rotate take-up tube 34. As take-up tube 34 rotates, blind cord 72 is wound around take-up tube 34 causing the end of blind cord 72 attached to blind fabric 80 to be drawn toward headrail 12. Once, blind fabric 80 is drawn towards headrail 12, the weight of blind fabric 80 acting upon blind cord 72 creates a torque on take-up tube 34 that would tend to cause blind cord 72 to rotate take-up tube 34 in the clockwise direction, thus allowing blind fabric 80 to drop away from headrail 12. The initial torque supplied by spring 60 in the clockwise direction is larger than the torque created by the weight of fabric 80, thus blind fabric 80 is held in position until a manual torque that overcomes the initial torque is delivered at clutch 54 through endless pull cord 56. To lower blind fabric 80, endless pull cord 56 is pulled on the right of bi-directional friction brake 54, which applies a clockwise torque on drive core 58. When this manually applied torque exceeds the initial torque of varying-diameter spring 60 in the counter-clockwise direction, drive core 58 rotates, which rotates drive shaft 48 in the clockwise direction. Take-up tube 34 is then rotated allowing blind cord 72 to unwind from take-up cord 72 is unwound, blind fabric 80 is lowered.

Varying-diameter spring 60 has a first section of coils 61 adjacent to a second section of coils 63. The spring 60 is placed around drive core 58 and within clutch housing 64 so that drive core 58, brake housing 64 and varying diameter spring 60 share a common longitudinal axis. First section of coils 61 has a diameter that is approximately equal to the diameter of drive core 58. Second section of coils 63 has a diameter that is approximately equal to the diameter of brake housing 64. When drive core 58 is rotated in the clockwise direction, the coils of first coil section 61 will grip drive core 58 and further cause the coils of second coil section 63 to retract away from the cylindrical inner surface of brake housing 64. This allows easier rotation of drive core 58 relative to brake housing 64. And, when drive core 58 is rotated in the counter-clockwise direction, the coils of second coil section 63 will expand out against the cylindrical surface of brake housing 64 and the coils of first coil section 61 will expand out away from drive core 58. This allows easier rotation of drive core 58 relative to brake housing 64. When the blind fabric 80 is in the raised position, the weight of blind fabric 80 creates a torque in the clockwise direction. Thus, the initial torque provided by varying-diameter spring 60 acting in the counter-clockwise direction is designed to exceed the torque created by the weight of blind fabric 80. Conversely, when the blind fabric 80 is manually raised, the torque created by the weight of blind fabric 80 must be overcome. For this reason, the pre-torque created by varying-diameter spring 60 in the clockwise direction is designed to be minimal.

A routing hole 69 extends through brake cover 62 and brake housing 64. Routing hole 69 allows a blind cord 72 to be routed from the interior of headrail 12 to the exterior of headrail 12 on either side of bottom face 14. Thus, a blind cord 72 could run from a take-up tube 34 directly through routing hole 69 above bottom face 14. Alternatively, routing hole 69 could be situated below bottom face 14 and the blind cord 7 would then run below bottom face 14 and then out through routing hole 69.

Preferably, take-up tube 34 is seamless. A seamless tube offers the advantage of a smoother surface which makes the winding and unwinding of blind cord 72 easier. Also, a seamless tube which has been anodized will not discolor blind cord 72.

Figure 9:
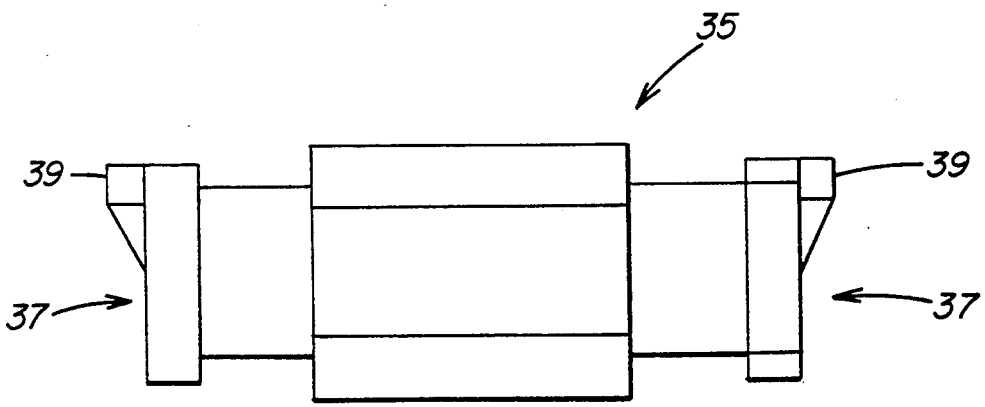
FIG. 9 is a front view of the dual stop.

Additionally, multiple take-up tubes 34 could be threadably mated to threaded guide 32. The preferred variation of this embodiment employs two take-up tubes 34. In this embodiment, each take-up tube 34 has a threaded insert 36 and its own drive means. Between each pair of take-up tubes 34 is a dual-stop 35, shown in FIG. 9, disposed around threaded guide 32. Dual-stop 35 has two surfaces 37 that face in opposite directions to one another, one surface facing each take-up tube 34. Each dual-stop surface 37 has a ledge 39 as does each threaded insert 36. As a take-up tube 34 reached dual-stop 35, an insert ledge on threaded insert 36 will contact a dual-stop surface ledge 39 and prevent take-up tube 34 from moving further in that direction.

Variations of the preferred embodiment could be made. For example, headrail 12 need not be U-shaped. Headrail 12 could be a long rectangular face with the cradles and clutch secured thereto. Also, headrail 12 need not be open ended. Headrail 12 could instead have one or both ends be sided. In this embodiment, threaded guide 32 could be fixed directly to the frame end. Similarly, clutch cover 62 could be fixed directly to the opposite frame end.

Also, although two cradles 44 are disclosed in the preferred embodiment, any number of cradles 44 may be used to support take-up tube 34. And although cradles 44 are disclosed as fixed to bottom face 14, they could be fixed to front face 16, rear face 18 or any combination of faces. In fact, any convenient means of rotatably securing take-up tube 34 may be employed instead of cradles 44.

The preferred means of rotating drive core 54 is an endless pull cord 56 engaged to protrusions 66 of drive core 58. However, any means can be used to rotate drive clutch 54 such as engaging circuit 54 with an elongated pull cord.

Also, the preferred means of connecting blind cord 72 to take-up tube 34 is by tube clip 74. However, any convenient means can be used such as gluing, taping or passing cord 72 through a hole in take-up tube 34 and knotting the end of cord 72.

Both the extending portion 24 of endplug 20 and threaded insert 36 are described in the preferred embodiment as having an annular outer surface, however, these surfaces can have any configuration.

While present preferred embodiments of the invention have been shown, it is distinctly understood that the invention . not limited thereto but may be otherwise variously embodied within the scope of the following claims.

I claim:

1. A device for raising and lowering window blind fabric comprising.

an elongated headrail;

at least one elongated take-up tube rotatably fixed to said headrail;

at least one elongated cord, each of said at least one elongated cord being fixed at one end to one of said at least one take-up tube and having an opposite end connectable to such window blind fabric; and a drive core rotatably disposed within a bi-directional friction brake, said drive core being connected to said take-up tube, said bi-directional friction brake being fixed to said headrail.

2. The device of claim 1, wherein said headrail is U-shaped.

3. The device of claim 1, further comprising an endless pull cord engaged to said drive core.

4. The device of claim 1, further comprising an elongated pull cord engaged to said drive core.

5. The device of claim 1, wherein said take-up tube is hollow.

6. The device of claim 5, wherein said take-up tube is a seamless tube.

7. The device of claim 5, wherein a threaded guide is oriented longitudinally and fixed to said headrail and said take-up tube is disposed around and threadably engaged to said threaded guide, in which as said tube is rotated, said tube translates along the length of said threaded guide.

8. The device of claim 1, further comprising a tube clip for fixing one end of said elongated cord to said take-up tube, said tube clip fitting snugly around said take-up tube, said tube clip further having a channel in which said elongated cord is disposed therethrough.

9. The device of claim 7, further comprising a threaded insert fixed to one end of said take-up tube, said threaded insert threadably engaged to said threaded guide.

10. The device of claim 9, further comprising an endplug fixed to one end of said headrail.

11. The device of claim 10, wherein said threaded insert has a surface having a ledge extending perpendicular from said threaded insert surface, and said endplug has a surface having a ledge extending perpendicular from said endplug surface, and said threaded insert surface is parallel to said endplug surface so that said ledge on said threaded insert surface contacts said ledge of said endplug surface once said threaded insert has travelled sufficiently close to said endplug.

12. The device of claim 10, further comprising a tube plug fixed to an end of said take-up tube opposite to an end having said threaded insert, said tube plug having a plug hole.

13. The device of claim 12, further comprising an elongated drive shaft, said drive shaft having one end fixed to said drive core and having another end disposed through said plug hole, said drive shaft and said plug hole sized and configured to engage one another during rotation but further sized and configured to not engage one another in the axial direction.

14. The device of claim 13, wherein said plug hole is rectangular in shape and said drive shaft is rectangular in cross-section.

15. A device for raising and lowering window blind fabric, comprising:

an elongated headrail;

an elongated take-up tube rotatably fixed to said headrail;

an elongated cord fixed at one end to said take-up tube and having an opposite end connectable to such window blind fabric; and a brake housing fixed to said headrail, said brake housing having a drive core seated therein;

a brake cover fixed to said brake housing; and said brake housing and said brake cover each having a routing hole extending therethrough, said routing hole being sized and configured to allow said elongated cord to pass therethrough.

16. A device for raising and lowering an elongated section of window blind fabric, comprising, an elongated headrail, said headrail having a groove extending longitudinally along said headrail; and an elongated offset profile placed within said groove so that when an edge of said blind fabric is also placed within said groove, said offset profile and said blind fabric are secured within said groove, said offset profile further having an angled longitudinal edge.

* * * * *

UNITED STATES PATENT AND TRADEMARK OFFICE

CERTIFICATE OF CORRECTION

PATENT NO. : 5,184,660

DATED : February 9, 1993

INVENTOR(S) : RALPH JELIC

It is certified that error appears in the above-identified patent and that said Letters Patent is hereby corrected as shown below:

Column 6, line 52, change "circuit" to --clutch--.

Signed and Sealed this

Fourteenth Day of December, 1993

*Attest:*

*Attesting Officer*

BRUCE LEHMAN

*Commissioner of Patents and Trademarks*